US006840867B1

(12) United States Patent
Chang

(10) Patent No.: US 6,840,867 B1
(45) Date of Patent: Jan. 11, 2005

(54) BILLIARD CUE TIP

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/653,204

(22) Filed: Sep. 3, 2003

(51) Int. Cl.[7] ..... A63B 15/12
(52) U.S. Cl. ..... 473/44
(58) Field of Search ..... 473/44–51

(56) References Cited

U.S. PATENT DOCUMENTS

| | | | | | |
|---|---|---|---|---|---|
| 644,681 | A | * | 3/1900 | Page | 473/49 |
| 908,021 | A | * | 12/1908 | Marsh | 473/49 |
| 1,201,677 | A | * | 10/1916 | Bechle | 473/49 |
| 1,525,825 | A | * | 2/1925 | Pappas | 473/49 |
| 1,677,282 | A | * | 7/1928 | Guthrie et al. | 473/49 |
| 1,694,375 | A | * | 12/1928 | Darmis | 473/49 |
| 2,544,970 | A | * | 3/1951 | Watson | 473/49 |
| 3,226,119 | A | * | 12/1965 | Foy | 473/49 |
| 3,554,544 | A | * | 1/1971 | Wodarczyk | 473/49 |
| 3,580,576 | A | * | 5/1971 | Merola | 473/49 |
| 3,695,611 | A | * | 10/1972 | Lower et al. | 473/51 |

* cited by examiner

*Primary Examiner*—Mark S. Graham
(74) *Attorney, Agent, or Firm*—Browdy and Neimark, P.L.L.C.

(57) ABSTRACT

A billiard cue tip includes a generally cylindrical base made of bakelite. The base has a top surface with a receiving room at the center portion thereof and a bottom surface for attaching to one end of a billiard cue. The cue tip further comprises a core made of leather. The configuration of the core is adapted to be tightly filled in the receiving room of the base in such a way that the top surface of said core is at the same level with the top surface of said base. Thereby, the base made of bakelite and the core made of leather combined together can provide the needed property to the cue tip for easily causing a cue ball to jump and controlling the running path of the cue ball in a jump shot.

2 Claims, 2 Drawing Sheets

BILLIARD CUE TIP

BACKGROUND OF THE INVENTION

1. Field of the Invention

This invention relates to billiard cue tips and more particularly to an improved billiard cue tip including two portions made of different materials for getting a better performance at jump shot or breaking.

2. Description of the Related Art

The use of blocking shots in safety play has become more popular recently. For defeating the block a jump shot skill is used. However, the standard cue stick do not meet the requirement for jump shots, with a resulting that a jump cue stick for easily causing a cue ball to jump is developed. In such a jump cue stick a tip made of bakelite is used for having an appropriate hardness. Nevertheless, the tip made of bakelite cannot control the cue ball well.

SUMMARY OF THE INVENTION

Accordingly, it is a primary object of this invention to provide an improved billiard cue tip with a configuration that will afford better jumping shot and breaking shot.

It is another object of this invention to provide a billiard cue tip that is more durable than do the tips of the jump cue sticks presently available.

To achieve above objects, this invention is a billiard cue tip which comprises a generally cylindrical base made of bakelite. The base has a top surface with a receiving room at the center portion thereof and a bottom surface for attaching to one end of a billiard cue. The cue tip further comprises a core made of leather. The configuration of the core is adapted to be tightly filled in the receiving room of the base in such a way that the top surface of said core is at the same level with the top surface of said base.

Thereby, the base made of bakelite and the core made of leather combined together can provide the needed property to the cue tip for easily causing a cue ball to jump and controlling the running path of the cue ball in a jump shot.

BRIEF DESCRIPTION OF THE DRAWINGS

These and other attributes of the invention will become more clear upon a through study of the following description of the best mode for carrying out the invention, particularly when reviewed in conjunction with the drawings, wherein.

DETAILED DESCRIPTION OF THE PREFERRED EMBODIMENTS

Figure 1:
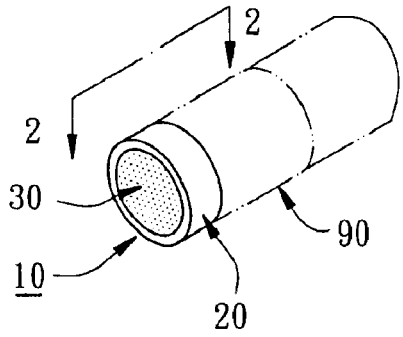
FIG. 1 is an enlarged detail view of the cue tip of this invention.
Figure 2:
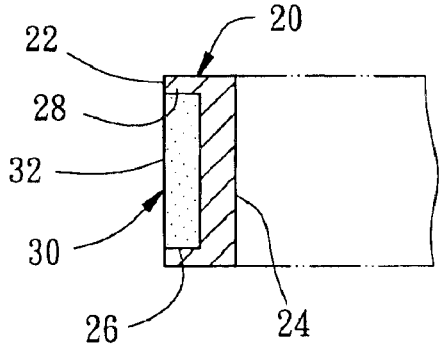
FIG. 2 is a cross sectional view taken along the line 2—2 of FIG. 1.

Referring now to the drawings, it will be seen that a cue tip embodying features of this invention and indicated as 10 is attached to one end of a billiard cue 90. The cue tip 10 includes a base 20 and a core 30.

The base 20 is made of bakelite and generally cylindrical in shape with a top surface 22 and a bottom surface 24. A cylindrical depression is provided from the center portion of the top surface 22 through the body of the base 20 to form a receiving room 26. The axis of the receiving room 26 and that of the base 20 are the same to form an annular edge 28 with an identical width in the whole body thereof. The depth of the receiving room 26 is one half of the height of the base 20.

The core 30 is made of leather and generally cylindrical in shape. The core 30 has a diameter being slightly less than that of the receiving room 26 for being tightly filled therein. The core 30 has a height identical to the depth of the receiving room 26 such that when it is received in the receiving room 26, the top surface 32 of the core 30 and that of the base 20 are at the same level.

Figure 3:
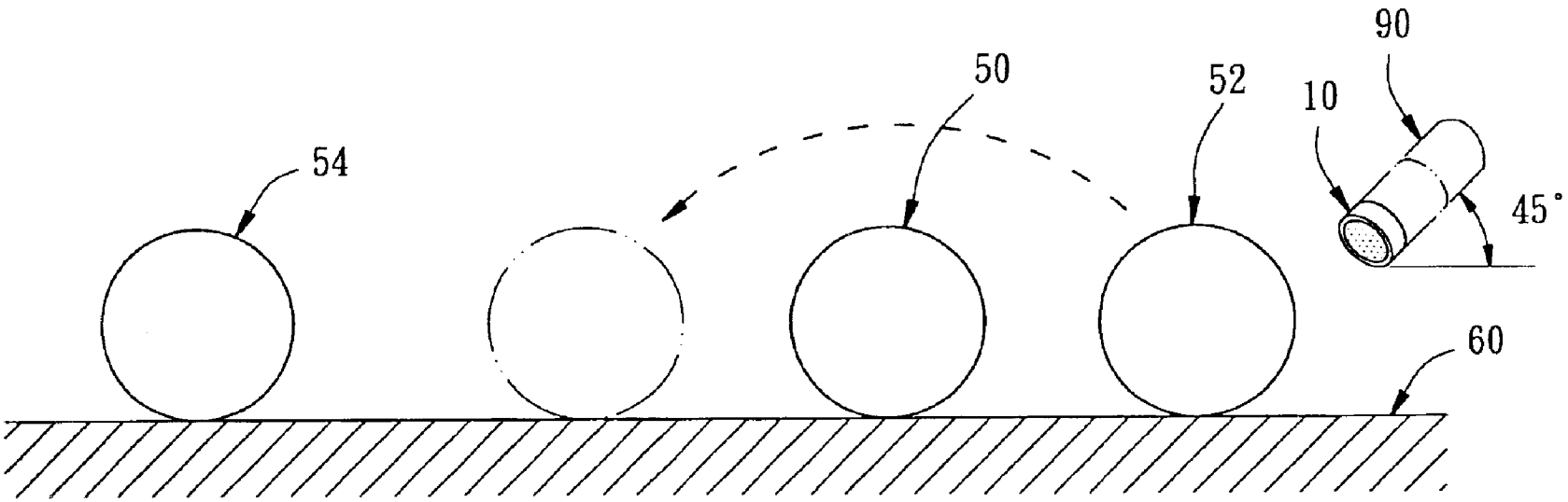
FIG. 3 is a side elevational view of this invention as it is used to do a jump shot.

The jump shot cue 90 is used as depicted in FIG. 3, where an opponent's blocking ball 50 has been positioned between the cue ball 52 and the object ball 54.The cue stick is held above the cue ball 52 to be struck and offset therefrom at a forty five degree angle to the table 60 such that the cue ball 52 is struck by the edge of the cue tip 10 so as to make the cue ball hop off the table. In such a situation, for the portion of the cue tip 10 contacting the cue ball being composed by 80% bakelite and 20% leather, it will have the needed hardness and controllability not only to cause the cue ball 52 to jump easily but also to let the cue ball 52 to run precisely at an intended path.

Figure 4:
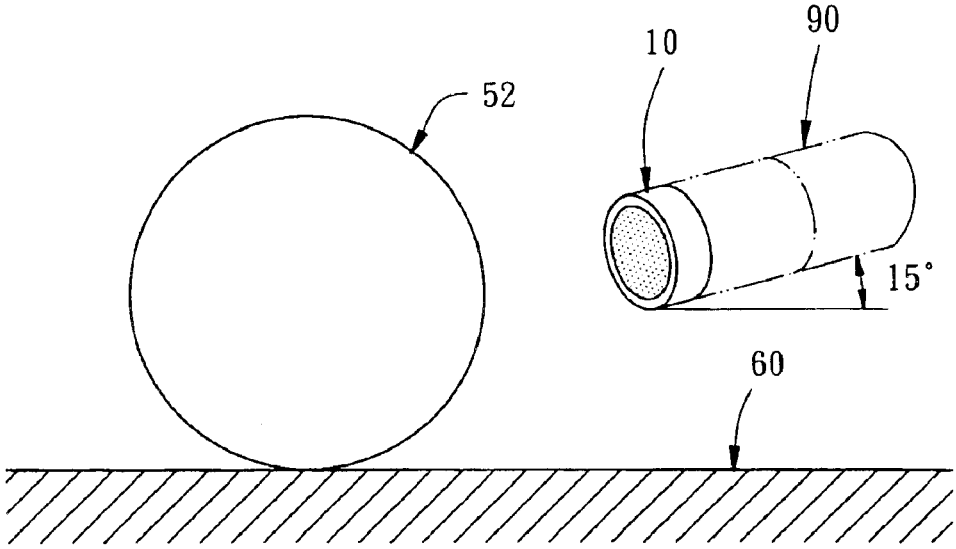
FIG. 4 is a side elevational view of this invention as it is used to do a break shot.

The jump shot cue 90 is used to break as depicted in FIG. 4. The cue stick is held above the cue ball 52 to be struck at a fifteen-degree angle to the table 60 such that the cue ball 52 is struck by the center portion of the tip 10. For being composed by 80% leather and 20% bakelite in such a situation, the portion of the tip 10 contacting the cue ball in the break shot has the needed property to afford a greater degree of control. The result is that the cue ball can run at an intended speed and path.

Additionally, for the hardness of the base 20 made of bakelite being greater than that of the core 30 made of leather and the core 30 being surrounded by the annular edge 28 of the base 20, the base 20 can afford a protection to the core being damaged when making the shot. This, of course, affords the cue tip made according to this invention is more durable than do the tips of the jump cue sticks presently available.

While the preferred embodiment of this invention has been described herein, variations in the design may be made. The scope of this invention, therefore, is only to be limited by the claims appended hereto.

What is claimed is:

1. A billiard cue tip comprising:

a generally cylindrical base made of bakelite, which has a top surface with a receiving room at the center portion thereof and a bottom surface for attaching to one end of a billiard cue;

a core made of leather, which is adapted to be tightly filled in said receiving room;

wherein said receiving room of said base is cylindrical in shape and has a diameter to be slightly larger than that of said core;

wherein the depth of said receiving room is one half of the height of said base; and wherein the height of said core is identical to the depth of said receiving room such that the top surface of said core and that of said base are at the same level when said core being received in said receiving room.

2. A billiard cue tip according claim 1, wherein said base and said receiving room have the same axis to form an annular edge with an identical width in the whole body thereof to surround said core.

* * * * *